US007969093B2

(12) United States Patent
Park et al.

(10) Patent No.: US 7,969,093 B2
(45) Date of Patent: Jun. 28, 2011

(54) PLASMA DISPLAY PANEL WITH CONTRAST-IMPROVING COMPOSITION IN THE BARRIER LAYER

(75) Inventors: Jin Woo Park, Seoul (KR); Gi Jin Kwon, Seoul (KR); Yoon Kwan Lee, Seoul (KR); Kwon Hue Son, Seoul (KR)

(73) Assignee: LG Electronics Inc., Seoul (KR)

( * ) Notice: Subject to any disclaimer, the term of this patent is extended or adjusted under 35 U.S.C. 154(b) by 572 days.

(21) Appl. No.: 11/868,140

(22) Filed: Oct. 5, 2007

(65) Prior Publication Data

US 2008/0211405 A1 Sep. 4, 2008

(30) Foreign Application Priority Data

Oct. 9, 2006 (KR) ..... 10-2006-0097896

(51) Int. Cl.
*H01J 9/24* (2006.01)
*H01J 17/49* (2006.01)
*H01J 9/00* (2006.01)

(52) U.S. Cl. ..... 313/582; 313/581; 313/586; 445/24; 315/169.4

(58) Field of Classification Search ..... None
See application file for complete search history.

(56) References Cited

U.S. PATENT DOCUMENTS

| | | | | |
|---|---|---|---|---|
| 6,371,822 | B1 | 4/2002 | Oh | |
| 2003/0224688 | A1 | 12/2003 | Sugimoto | |
| 2005/0017640 | A1 * | 1/2005 | Kwon et al. | 313/586 |
| 2005/0225244 | A1 * | 10/2005 | Ahn et al. | 313/582 |
| 2006/0038492 | A1 * | 2/2006 | Song | 313/586 |
| 2006/0175949 | A1 * | 8/2006 | Jeong | 313/292 |

FOREIGN PATENT DOCUMENTS

| | | | |
|---|---|---|---|
| EP | 0 382 260 | A2 | 8/1990 |
| EP | 1 6880982 | | 8/2006 |
| KR | 10-2001-0037347 | | 5/2001 |
| KR | 10-2005-0099716 | | 10/2005 |
| WO | WO 2004-053915 | * | 6/2004 |

OTHER PUBLICATIONS

European Search Report dated Sep. 23, 2009 for Application No. 07118130.9, 11 pages.
European Search Report dated Feb. 26, 2009 for Application No. 07118130.9, 6 pages.

* cited by examiner

*Primary Examiner* — Anne M Hines
*Assistant Examiner* — Tracie Green
(74) *Attorney, Agent, or Firm* — Fish & Richardson P.C.

(57) ABSTRACT

A plasma display panel and a manufacturing method thereof are disclosed. The panel includes a substrate having a plurality of discharge cells, and barrier ribs defining the discharge cells, the barrier ribs contain carbon in an amount of 0.1 to 10% by weight.

22 Claims, 8 Drawing Sheets

PLASMA DISPLAY PANEL WITH CONTRAST-IMPROVING COMPOSITION IN THE BARRIER LAYER

This application claims the benefit of the Korean Patent Application No. 10-2006-0097896, filed on Oct. 9, 2006, which is hereby incorporated by reference as if fully set forth herein.

BACKGROUND OF THE INVENTION

1. Field of the Invention

The present invention relates to a plasma display panel (PDP), and more particularly to a plasma display panel having an improved bright room contrast ratio and a method for manufacturing the plasma display panel.

2. Discussion of the Related Art

Plasma display panels (PDPs) are one of light emitting devices that display images using a discharge phenomenon. The plasma display panels are in the spotlight as a display device of an image display apparatus having a large screen, because the production process of the plasma display panel is simple since there is no need for installing active devices in each cell, the enlargement of a screen is easy, and the response rate is fast.

Such a plasma display panel has a structure as shown in FIG. 1, that is, an upper substrate 10 and a lower substrate 20 overlap one another by facing each other. The upper substrate 10 has a sustaining electrode pair arranged inside of a transparent substrate 11. Generally, the sustaining electrode pair includes a transparent electrode 12 and a bus electrode 13.

Such a plurality of sustaining electrode pairs are covered with a dielectric layer 14 for an AC drive, and a passivation layer is formed over a surface of the dielectric layer 14.

Meanwhile, inside of the lower substrate 20, address electrodes 22 are arranged on a lower plate 21, and a dielectric layer 23 is formed over the address electrodes 22. Barrier ribs 24 are formed on the dielectric layer 23 to define discharge cells 25. Phosphor layers 26 exhibiting red, blue, and green are coated over the discharge cells 25 defined by the barrier ribs 24 for color display.

The discharge cells 25 are defined into every sub-pixel by the barrier ribs 24, and a discharge gas is sealed in the discharge cells 25. Each pixel is consisting of three sub-pixels.

However, such a plasma display panel has a bad bright room contrast ratio.

Therefore, a method for improving the bright room contrast ratio by including a color filter on a front surface of a glass plate has been recently suggested. There also have been efforts to improve the bright room contrast ratio by coating or combining various materials on a front surface of the filter.

However, excellent results from the efforts to improve the bright room contrast ratio have yet to come.

SUMMARY OF THE INVENTION

Accordingly, the present invention is directed to a plasma display panel and a method for manufacturing the same that substantially obviates one or more problems due to limitations and disadvantages of the related art.

An object of the present invention is to provide a plasma display panel capable of greatly improving a bright room contrast ratio by fabricating barrier ribs such as to contain a predetermined amount of carbon, and a method for manufacturing the plasma display panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel includes a substrate having a plurality of discharge cells, and barrier ribs defining the discharge cells, wherein the barrier ribs may contain carbon in an amount of 0.1 to 10% by weight.

Here, the barrier ribs may be constituted of column barrier ribs formed in a vertical direction, and row barrier ribs formed in a horizontal direction. The column barrier rib has a height higher than the row barrier rib.

The column barrier rib may be constituted of first barrier ribs, and second barrier ribs aligned on the first barrier ribs. The first and second barrier ribs may have a carbon content different from each other.

Moreover, the first and second barrier ribs may have a surface color shade depth different from each other, and the second barrier rib may have a surface reflectance of 40% or less.

In another aspect of the present invention, a plasma display panel includes a substrate having a plurality of discharge cells, row barrier ribs for defining the discharge cells, the row barrier ribs arranged in a horizontal direction of the substrate, and column barrier ribs for defining the discharge cells, the column barriers arranged in a vertical direction of the substrate, wherein the first and second barrier ribs may contain carbon in the amounts of 0.1 to 10% by weight, and the second barrier ribs may have a carbon content greater than the first barrier ribs.

Here, the row barrier ribs may contain carbon in an amount of 0.1 to 1% by weight, and the column barrier ribs may contain carbon in an amount of 0.1 to 10% by weight.

In yet another aspect of the present invention, a plasma display panel includes first barrier ribs for defining discharge cells, the first barrier ribs arranged in horizontal and vertical directions of the substrate; and second barrier ribs aligned on the first barrier ribs arranged in the vertical direction; wherein, the first and second barrier ribs may contain carbon in an amount of 0.1 to 10% by weight, and the second barrier ribs may have a carbon content greater than the first barrier ribs.

Here, the first barrier ribs may contain carbon in an amount of 0.1 to 1% by weight, and the second barrier ribs may contain carbon in an amount of 0.1 to 10% by weight.

Moreover, the second barrier ribs may have a surface color darker than the first barrier ribs.

In still another aspect of the present invention, a method for manufacturing a plasma display panel includes coating and patterning a barrier rib material on a substrate; developing and curing the patterned barrier rib material to form barrier ribs around discharge cells, in which the barrier ribs may contain carbon in an amount of 0.1 to 10% by weight.

Here, the step of coating and patterning a barrier rib material on a substrate may include coating and patterning a first barrier rib material on the substrate; and coating a second barrier rib material on the patterned first barrier rib material and patterning the second barrier rib material.

At this time, the first barrier rib material may be a photosensitive barrier rib material including 40 to 90% by weight of an inorganic substance and 10 to 60% by weight of an organic binder selected from an epoxy resin, an unsaturated polyester resin, a phenol resin, a melamine resin, a urethane resin, a polysiloxane silicate, and the mixtures thereof. The second barrier rib material may be a photosensitive barrier rib material including 40 to 90% by weight of an inorganic substance, and 10 to 60% by weight of an organic binder containing a great amount of aromatic groups in branched groups of the binder.

Moreover, the first barrier rib material may have a burn-out temperature of 550° C. or lower, and the second barrier rib material may have a burn-out temperature of 600° C. or higher.

In addition, the first barrier rib material may have a refractive index of 1.4 or less, and the second barrier rib material may have a refractive index of 1.5 or greater.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the present invention, examples of which are illustrated in the accompanying drawings.

Figure 1:
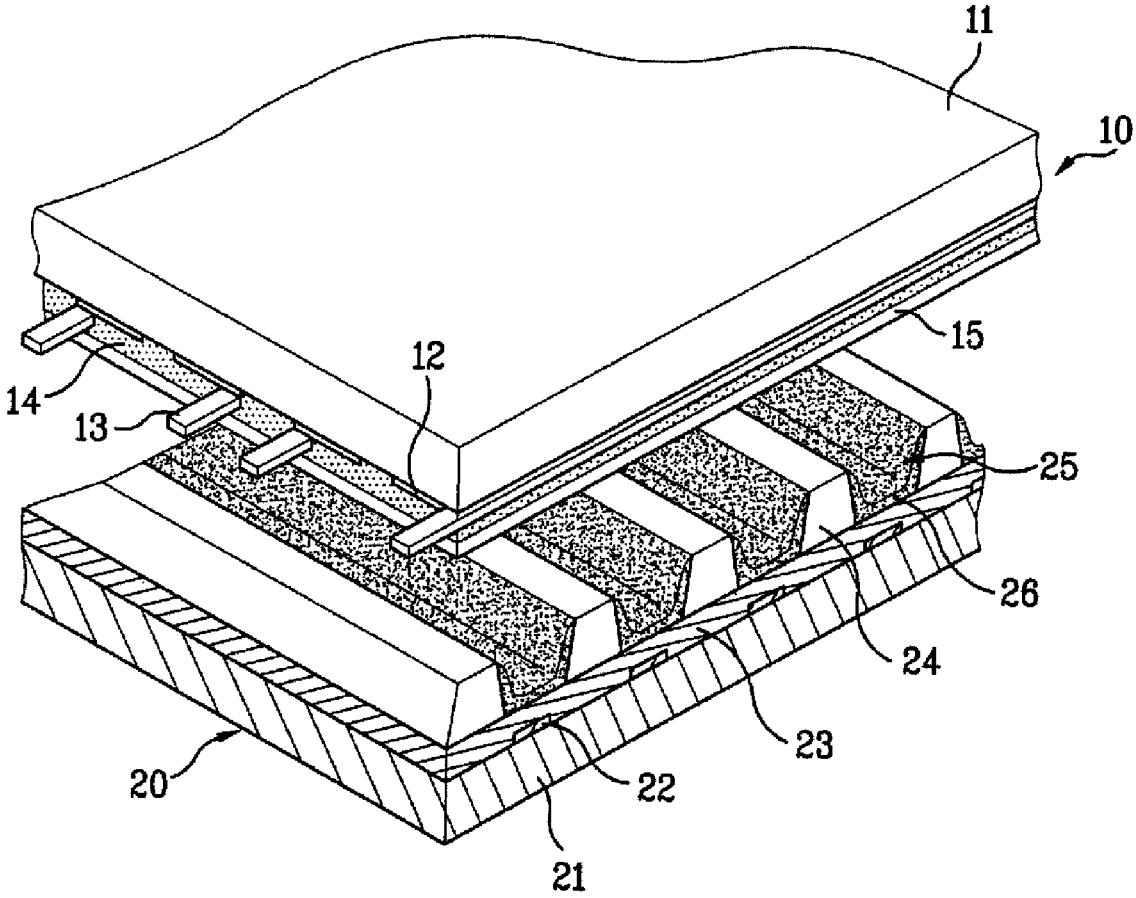
FIG. 1 Related Art
FIG. 1 is a drawing illustrating a typical plasma display panel (PDP)
Figure 2:
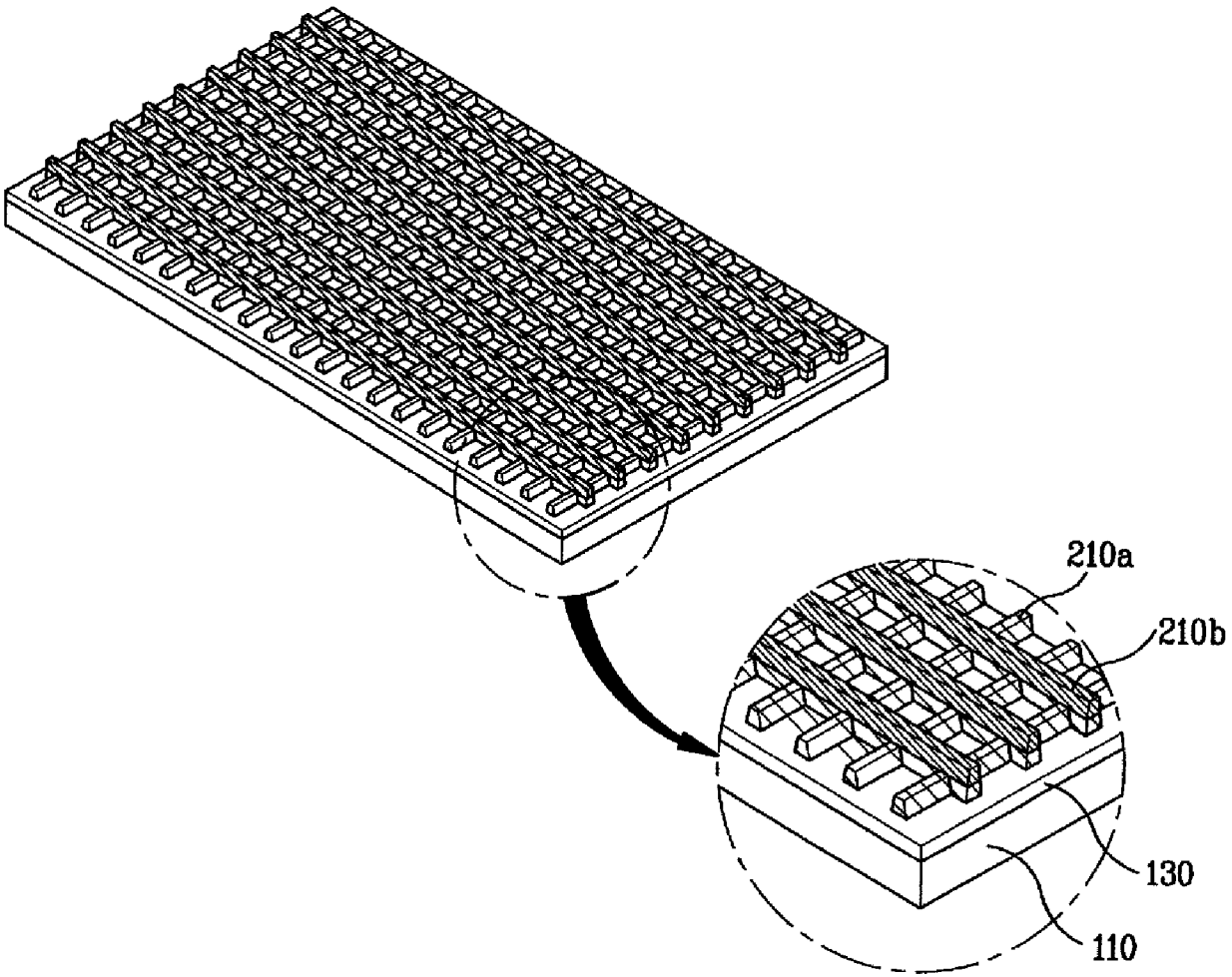
FIG. 2 is a drawing illustrating a lower substrate of a plasma display panel according to the present invention.

FIG. 2 is a drawing illustrating a lower substrate of a plasma display panel according to the present invention.

The plasma display panel according to the present invention is formed such that an upper substrate, i.e., a front display surface, for displaying images and a lower substrate for forming the rear surface are attached facing each other with a predetermined distance in between.

The upper substrate has a plurality of sustaining electrode pairs each including a scan electrode and a sustain electrode formed on a front surface of a glass. An upper dielectric layer is laminated on the front surface of the glass, where the scan electrodes and sustaining electrodes are arranged in parallel, for limiting the discharge current. In addition, a passivation layer having magnesium oxide (MgO) deposited thereon by the sputtering generated during the plasma discharge is formed over the upper dielectric layer to prevent damage in the upper dielectric layer, as well as to increase discharge efficiency of secondary electrons.

The lower substrate includes a plurality of address electrodes arranged orthogonal to the sustaining electrode pairs, which are arranged in parallel on the front surface of the upper substrate. A lower dielectric layer is formed over the address electrodes for accumulation of wall charges. In addition, barrier ribs defining the discharge cells are formed on the lower dielectric layer, and phosphor layers are coated on the discharge cells to generate visible rays having any one of red (R), green (G), and blue (B) colors at discharge.

Barrier ribs formed in the plasma display panel of the present invention having such a structure, as shown in FIG. 2, are formed on a lower dielectric layer 130 on a substrate 110. The barrier ribs are constituted of well type first barrier ribs 210*a* defining discharge cells by surrounding the discharge cells with row barrier ribs and column barrier ribs, and stripe type second barrier ribs 210*b* further formed as column barrier ribs on the first barrier ribs 210*a*. Therefore, the second barrier ribs 210*b* are formed on the first barrier ribs 210*a* so that the barrier ribs are formed to have different heights in the row barrier ribs and the column barrier ribs.

Such a difference in the barrier ribs may prevent phosphors from flowing into the adjacent discharge cells at coating the phosphors on the discharge cells, thereby preventing mixture of colors.

Therefore, in the present invention, the barrier rib in the vertical direction has a height higher than the barrier rib in the horizontal direction.

Moreover, the difference in the height of the barrier ribs of the present invention may improve an emission characteristic in addition to a discharge characteristic of the plasma display panel.

When fabricating the barrier ribs in the plasma display panel according to the present invention with such a structure, the barrier ribs may be formed by coating the photosensitive barrier rib material in a form of paste or green sheet.

In the present invention, it is preferable that the green sheet is used to form the barrier ribs with a uniform thickness.

Figure 3:
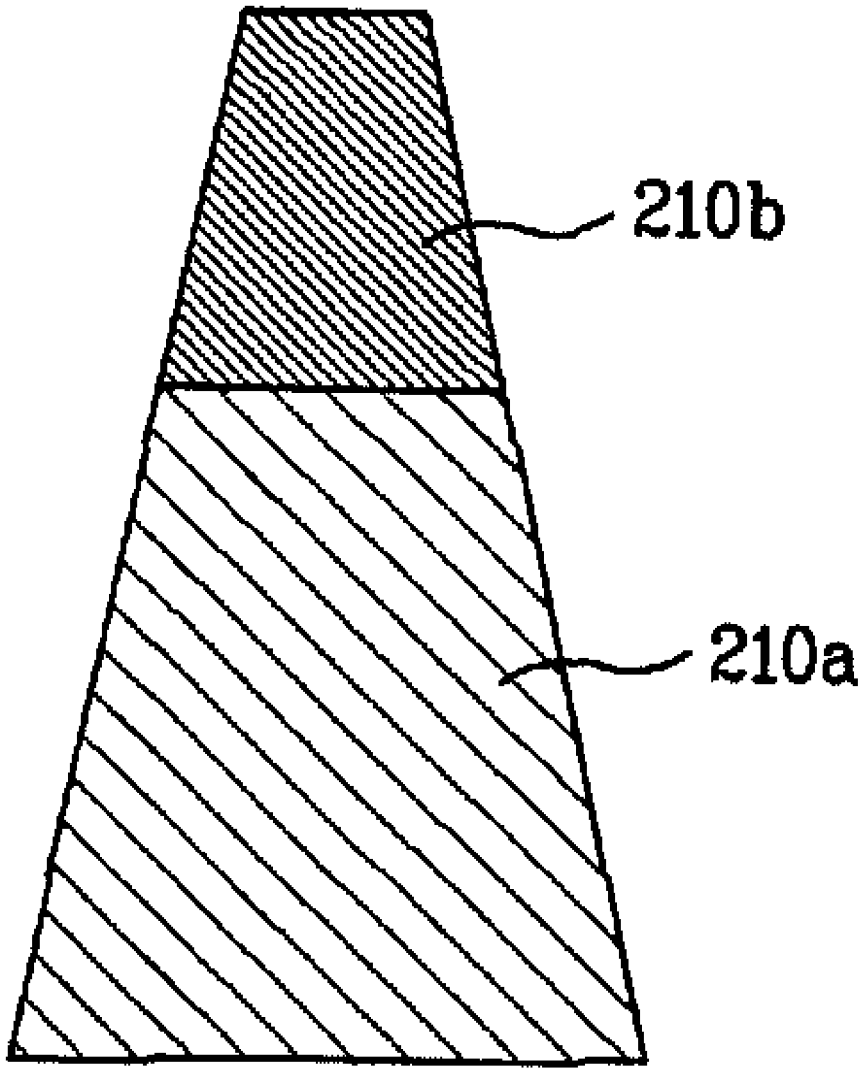
FIG. 3 is a sectional view illustrating a barrier rib structure of FIG. 2.

FIG. 3 is a sectional view illustrating a barrier rib structure of FIG. 2.

As shown in FIG. 3, the difference in the barrier ribs according to the embodiment of the present invention may have a difference in a surface color shade depth of the first barrier ribs 210*a* and the second barrier ribs 210*b*.

Here, the second barrier ribs 210*b* may have the surface color darker than the first barrier ribs 210*a*.

This is because, the amount of carbon contained in the first and the second barrier ribs 210*a* and 210*b* are different.

The first barrier ribs 210*a* may contain carbon in an amount of 0.1 to 1% by weight, and the second barrier ribs 210*b* may contain carbon in an amount of 0.1 to 10% by weight.

Here, the carbon content is determined according to a burn-out temperature of an organic binder polymer contained in the barrier rib material to be coated for forming the barrier ribs.

Therefore, the first barrier ribs 210*a* having a low carbon content is formed by applying the barrier rib material containing an organic binder polymer with a low burn-out temperature. On the other hand, the second barrier ribs 210*b* having a high carbon content is formed by applying the barrier rib material containing an organic binder polymer with a high burn-out temperature.

When these barrier rib materials are cured, carbon in the barrier rib material with a high burn-out temperature remains in a greater amount than in the barrier rib material with a low burn-out temperature.

Therefore, the second barrier ribs 210*b* containing a greater amount of carbon has a relatively darker surface color than that of the first barrier ribs 210*a* containing a lesser amount of carbon.

Accordingly, when the surface color of the barrier ribs 210*b* exhibit a dark color, a surface reflectance of the plasma display panel with respect to the light generated at discharge is reduced by 40% or less. Thus, there is an advantage in that the bright room contrast ratio is improved.

FIGS. 4A to 4H are drawings illustrating a process for manufacturing a plasma display panel according to the present invention.

Figure 4A:
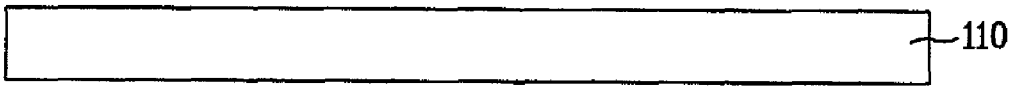
FIGS. 4A to 4H are drawings illustrating a process for manufacturing a plasma display panel according to the present invention.

FIGS. 4A to 4H illustrate the process for fabricating a lower substrate of the plasma display panel. As shown in FIG. 4A, first, a substrate 110 is prepared.

Here, it is preferable that the substrate 110 is a soda-lime glass or PD-200.

Figure 4B:
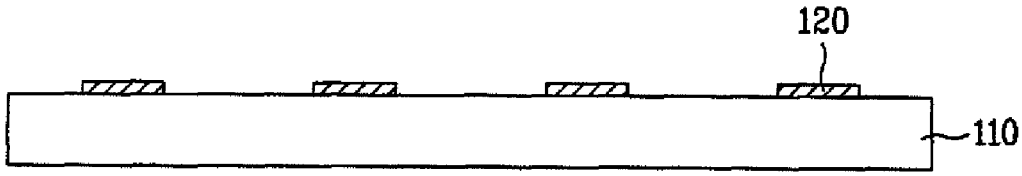
Figure 4C:
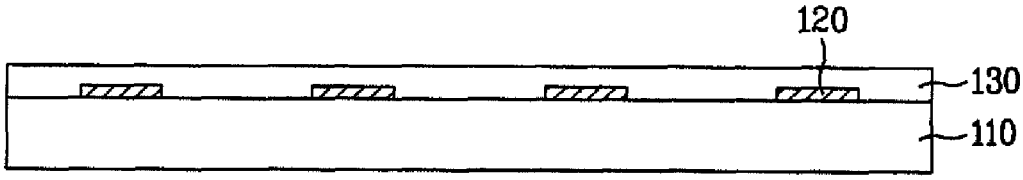

Next, as shown in FIG. 4B, address electrodes 120 are formed on the substrate 110. Then, as shown in FIG. 4C, a lower dielectric layer 130 are formed over the substrate 110 and the address electrodes 120. The lower dielectric layer 130 protects the substrate 110 and the address electrodes 120 and serves as a reflective layer for reflecting light that is generated at discharge to pass through the rare substrate to the back. In addition, barrier ribs are formed on the dielectric layer 130.

A process for forming the barrier ribs will be described in detail.

Figure 4D:
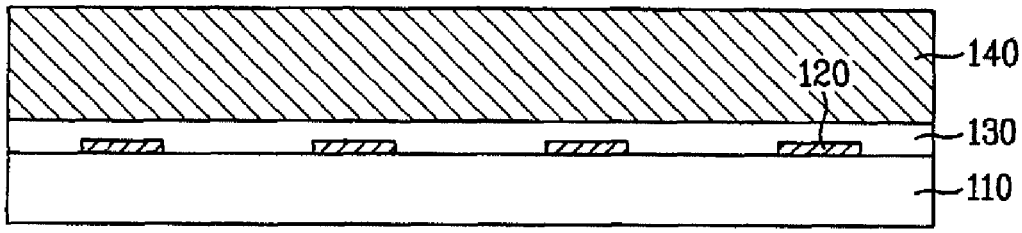

First, as shown in FIG. 4D, a first barrier rib material 140 is coated over the dielectric layer 130. Here, it is preferable that the first barrier rib material 140 has a burn-out temperature of 550° C. or lower, and a refractive index of 1.4 or less. That is, the first barrier rib material 140 may be a photosensitive barrier rib material containing 40 to 90% by weight of an inorganic substance and 10 to 60% by weight of an organic binder selected from an epoxy resin, an unsaturated polyester resin, a phenol resin, a melamine resin, a urethane resin, a polysiloxane silicate, and mixtures thereof. The first barrier rib material 140 may be applied by printing the barrier rib material composition in a form of paste or laminating the barrier rib green sheet in a form of slurry.

Figure 4E:
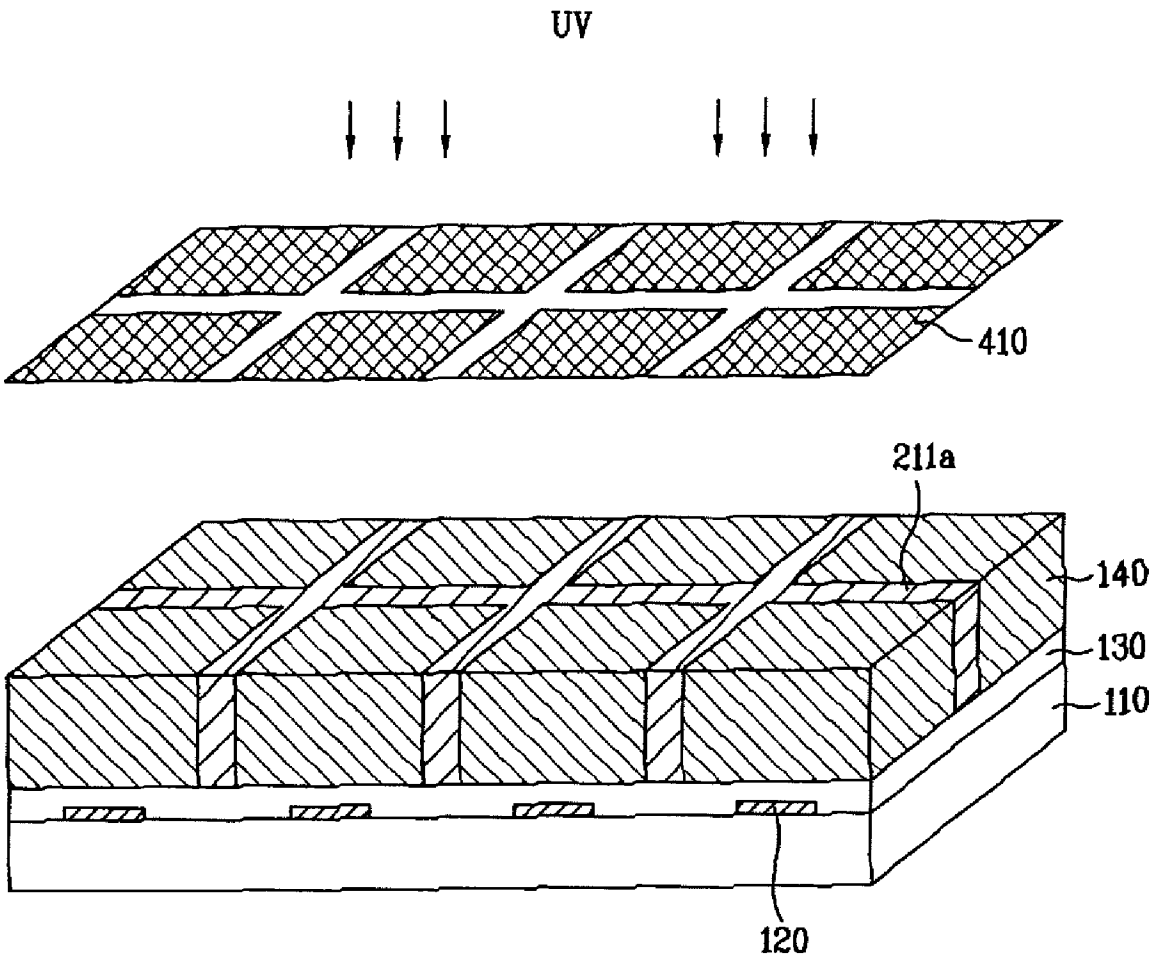

Subsequently, as shown in FIG. 4E, in order to pattern first barrier ribs 210*a* to be the lower barrier ribs, a well type photomask 410 is used to light-expose the first barrier rib material 140. By this exposure, a well type first light-cured part 211*a* is formed.

Figure 4F:
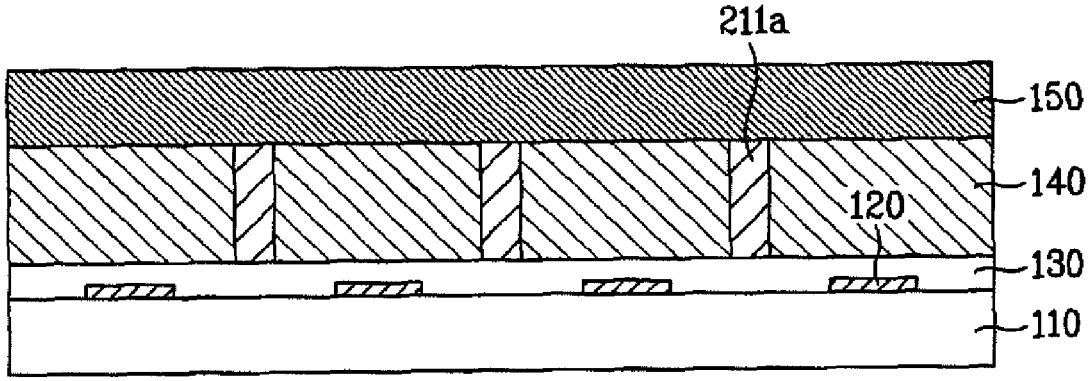

Then, as shown in FIG. 4F, a second barrier rib material 150 is applied on the first barrier rib material 140 whereon the light-cured part 211*a* is formed. Here, a height of the second barrier rib 150 is determined in the consideration of its shrinkability at a developing and curing process.

As the second barrier rib material 150, a barrier rib material having a burn-out temperature of about 600° C. or higher, and a refractive index of 1.5 or more may be used. That is, the second barrier rib material 150 may be a photosensitive barrier rib material containing 40 to 90% by weight of an inorganic substance and 10 to 60% by weight of an organic binder containing a great amount of aromatic groups in branched groups of the binder. The second barrier rib material 150 may be applied by printing the barrier rib material composition in a form of paste or laminating the barrier rib green sheet in a form of slurry.

Figure 4G:
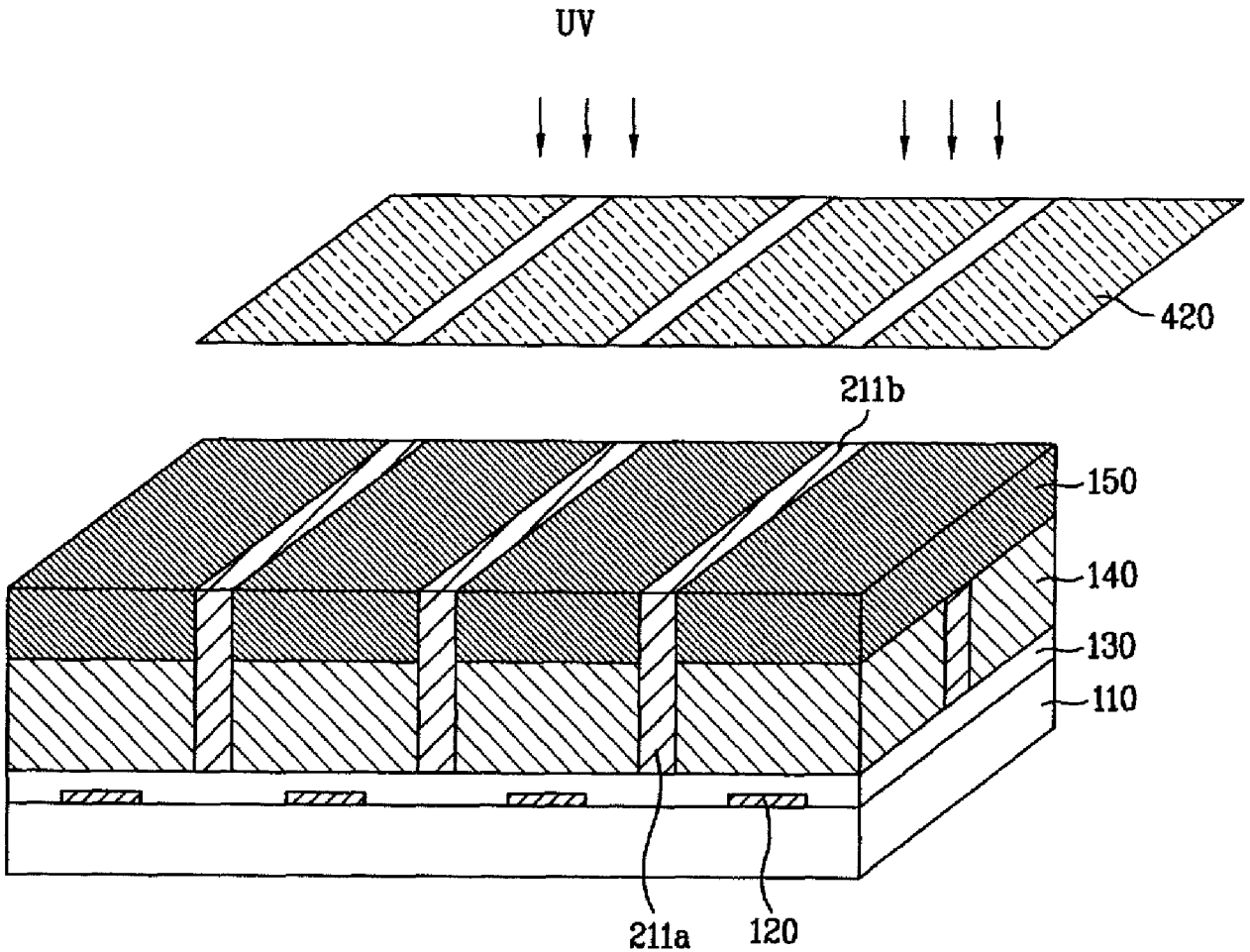

Subsequently, as shown in FIG. 4G, in order to form second barrier ribs 210*b*, a stripe type photomask 420 is used to light-expose the second barrier rib material 150. By this exposure, second barrier rib light-cured parts 211*b* corresponding to the second barrier ribs 210*b* are formed.

Figure 4H:
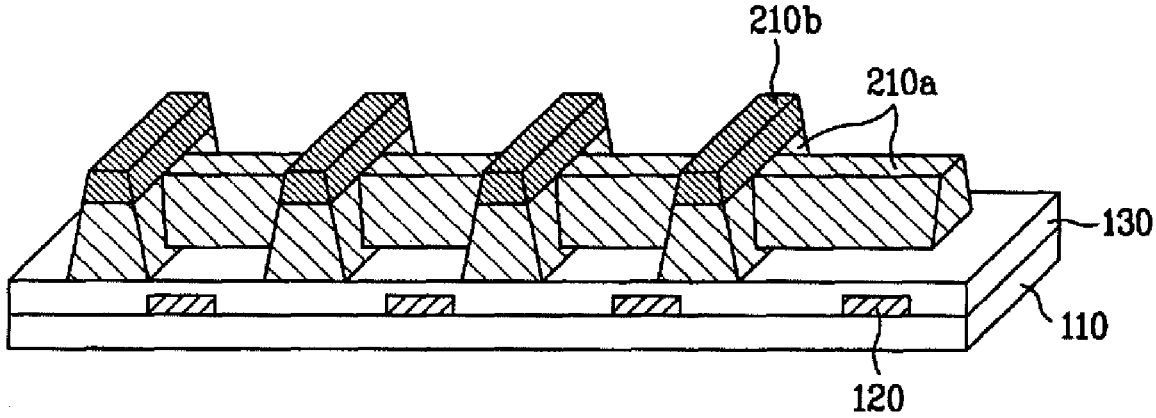

Next, as shown in FIG. 4H, after the above-mentioned light-exposure process, developing, drying, and curing processes are carried out to form differential barrier ribs consisting of the first and second barrier ribs 210*a* and 210*b* having a difference in the surface color shade depth.

As shown in FIG. 4H, the second barrier rib 210*b* has a surface color darker than the first barrier ribs 210*a*, so that the surface reflectance of the plasma display panel with respect to the light generated at discharge is reduced by about 40% or less. Thus, the bright room contrast ratio can be improved.

Accordingly, the barrier ribs of the present invention contain carbon in an amount of about 0.1 to 10% by weight. The barrier ribs are constituted of the column barrier ribs formed in a vertical direction of the substrate and the row barrier ribs formed in a horizontal direction of the substrate. And, the column barrier rib has a height higher than the row barrier ribs.

Here, the column barrier ribs may be aligned in the same direction as the address electrodes. The column barrier ribs are constituted of the first barrier ribs and the second barrier ribs aligned on the first barrier ribs.

Moreover, the first and second barrier ribs are formed to have different carbon content from each other. That is, the carbon content of the second barrier ribs is larger than that of the first barrier ribs.

For example, it is preferable that the first barrier ribs contain carbon in an amount of 0.1 to 1% by weight, and the second barrier ribs contain carbon in an amount of 0.1 to 10% by weight.

In addition, the first and second barrier ribs have a surface color shade depth different from each other. It is preferable that the second barrier rib has a surface color darker than the first barrier rib.

Here, the second barrier ribs may have a surface reflectance of 40% or less.

As another embodiment of the present invention, on a substrate having a plurality of discharge cells, row barrier ribs defining the discharge cells and arranged in a horizontal direction of the substrate, and column barrier ribs defining the discharge cells and arranged in a vertical direction of the substrate may be formed, respectively.

Here, the row and column barrier ribs contain carbon in an amount of 0.1 to 10% by weight. The column barrier rib has a carbon content larger than the row barrier rib.

That is, it is preferable that the row barrier rib contains carbon in an amount of 0.1 to 1% by weight, and the column barrier rib contains carbon in an amount of 0.1 to 10% by weight.

In addition, the column barrier rib has a height higher than the row barrier rib.

As another embodiment of the present invention, on a substrate having a plurality of discharge cells, first barrier ribs defining the discharge cells and arranged in horizontal and vertical directions, and second barrier ribs aligned on the first barrier ribs arranged in the vertical direction may be formed, respectively.

Here, the first and second barrier ribs contain carbon in an amount of 0.1 to 10% by weight. The second barrier rib has a carbon content larger than the first barrier rib.

That is, it is preferable that the first barrier rib contains carbon in an amount of 0.1 to 1% by weight, and the second barrier rib contains carbon in an amount of 0.1 to 10% by weight.

Moreover, the second barrier rib has a surface color darker than the first barrier rib.

Therefore, in the plasma display panel and the method for manufacturing a plasma display panel according to the present invention, by forming the barrier ribs such that the barrier ribs contain carbon in an amount of 0.1 to 10% by weight, the carbon content in the first and second barrier ribs are different, and the surface color of the first and second barrier ribs have differential shade depth, a bright room contrast ratio in addition to a discharge and emission characteristics of the plasma display panel can be improved.

Furthermore, when driving the plasma display panel, the brightness due to the address discharge is increased, thereby improving the contrast characteristic.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

What is claimed is:

1. A plasma display panel comprising:

a substrate having a plurality of discharge cells; and barrier ribs defining the discharge cells, the barrier ribs comprising first column barrier ribs and second column barrier ribs arranged on the first column barrier ribs;

wherein the barrier ribs contain carbon in an amount of 0.1 to 10% by weight and the second column barrier ribs have a carbon content greater than the carbon content of the first column barrier ribs, wherein the second column barrier ribs have a surface reflectance of 40% or less.

2. The panel according to claim 1, wherein a dielectric layer is arranged on the substrate and the barrier ribs are arranged on the dielectric layer.

3. The panel according to claim 1, wherein the barrier ribs comprise row barrier ribs formed in a horizontal direction of the substrate, the first column barrier ribs are formed in a vertical direction of the substrate, and the second column barrier ribs have a height higher than the row barrier ribs.

4. The panel according to claim 3, wherein the first and second column barrier ribs are aligned in the same direction as an address electrode line.

5. The panel according to claim 3, wherein the first column barrier ribs contain carbon in an amount of 0.1 to 1% by weight, and the second column barrier ribs contain carbon in an amount of 0.1 to 10% by weight.

6. The panel according to claim 5, wherein the first and second column barrier ribs have a surface color shade depth different from each other.

7. The panel according to claim 3, wherein the greater carbon content of the second column barrier ribs causes the second column barrier ribs to have a surface color shade deeper than the first column barrier ribs.

8. A plasma display panel comprising:

a substrate having a plurality of discharge cells;

row barrier ribs defining the discharge cells, the row barrier ribs arranged in a horizontal direction of the substrate; and column barrier ribs defining the discharge cells, the column barrier ribs arranged in a vertical direction of the substrate;

wherein the row and column barrier ribs contain carbon in an amount of 0.1 to 10% by weight, and the column barrier ribs have a carbon content larger than the row barrier ribs, wherein the column barrier ribs have a surface reflectance of 40% or less.

9. The panel according to claim 8, wherein the row barrier ribs contain carbon in an amount of 0.1 to 1% by weight, and the column barrier ribs contain carbon in an amount of 0.1 to 10% by weight.

10. The panel according to claim 8, wherein the column barrier ribs have a height higher than the row barrier ribs.

11. A plasma display panel comprising:

a substrate having a plurality of discharge cells;

first barrier ribs defining the discharge cells, the first barrier ribs arranged in horizontal and vertical directions of the substrate; and second barrier ribs aligned on the first barrier ribs arranged in the vertical direction;

wherein the first and second barrier ribs contain carbon in an amount of 0.1 to 10% by weight, and the second barrier ribs have a carbon content larger than the first barrier ribs, wherein the second barrier ribs have a surface reflectance of 40% or less.

12. The panel according to claim 11, wherein the first barrier ribs contain carbon in an amount of 0.1 to 1% by weight, and the second barrier ribs contain carbon in an amount of 0.1 to 10% by weight.

13. The panel according to claim 11, wherein the second barrier ribs have a height higher than the first barrier ribs, and wherein the first barrier ribs and the second barrier ribs have different surface color shade depths, the difference in surface color shade depth being caused by the difference in carbon content between the first barrier ribs and the second barrier ribs.

14. A plasma display panel comprising:

a substrate having a plurality of discharge cells; and barrier ribs defining the discharge cells and containing carbon in an amount of 0.1 to 10% by weight, wherein the barrier ribs have a double layer structure including a first layer and a second layer formed on the first layer, wherein the second layer has a carbon content larger than the first layer.

15. The panel according to claim 14, wherein the first layer includes a row barrier rib arranged in a row direction of the substrate and a first column barrier rib arranged in a column direction of the substrate, wherein the second layer includes a second column barrier rib formed on a upper surface of the first column barrier rib, and wherein the second column barrier rib has a carbon content larger than the first column barrier rib and the row barrier rib.

16. The panel according to claim 15, wherein the second column barrier rib has a surface reflectance of 40% or less.

17. The panel according to claim 14, wherein the second barrier layer has a surface reflectance of 40% or less.

18. The panel according to claim 15, wherein the first column barrier rib contains carbon in an amount of 0.1 to 1% by weight, and the second column barrier rib contains carbon in an amount of 0.1 to 10% by weight.

19. The panel according to claim 15, wherein the second column barrier rib is closest to the viewing side of the panel.

20. The panel according to claim 14, wherein the carbon content of the first layer includes residue of a first organic binder polymer, the carbon content of the second layer includes residue of a second organic binder polymer, and the second layer comprises a greater amount of residue of the second organic binder polymer than the first layer comprises of residue of the first organic polymer.

21. The panel according to claim 20, wherein the larger carbon content of the second layer causes the second layer to have a surface color shade deeper than the layer.

22. A plasma display panel comprising:

a substrate having a plurality of discharge cells; and barrier ribs defining the discharge cells, one or more of the barrier ribs having a first portion and a second portion, the second portion having a carbon content greater than the first portion, wherein the barrier ribs contain carbon in an amount of 0.1 to 10% by weight, and wherein the second portion has a surface reflectance of 40% or less, and wherein the greater carbon content of the second portion causes the second portion to have a surface color shade darker than the first portion.

* * * * *